US005470213A

United States Patent [19]

Iguchi et al.

[11] Patent Number: 5,470,213

[45] Date of Patent: Nov. 28, 1995

[54] SCROLL TYPE COMPRESSOR HAVING A RING FOR COMPRESSIVE FORCE TRANSMISSION AND ORBIT DETERMINATION

[75] Inventors: Masao Iguchi; Tetsuhiko Fukanuma; Tetsuya Yamaguchi; Tetsuo Yoshida, both of Kariya, all of Japan

[73] Assignee: Kabushiki Kaisha Toyoda Jidoshokki Seisakusho, Kariya, Japan

[21] Appl. No.: 227,061

[22] Filed: Apr. 13, 1994

Related U.S. Application Data

[63] Continuation-in-part of Ser. No. 128,827, Sep. 29, 1993.

[30] Foreign Application Priority Data

Apr. 13, 1993 [JP] Japan ..... 5-018759 U

[51] Int. Cl.[6] ..... F04C 18/04

[52] U.S. Cl. ..... 418/55.2; 418/55.3; 418/178; 418/179; 464/102

[58] Field of Search ..... 418/55.1, 55.3, 418/55.2, 179, 178; 464/102

[56] References Cited

U.S. PATENT DOCUMENTS

| | | | |
|---|---|---|---|
| 4,406,600 | 9/1983 | Terauchi et al. | 464/102 |
| 4,550,480 | 11/1985 | Tanikawa et al. | 418/55.1 |
| 4,589,828 | 5/1986 | Sato et al. | 418/55.3 |
| 5,188,520 | 2/1993 | Nakamura et al. | 418/55.1 |
| 5,242,283 | 9/1993 | Mori et al. | 418/55.2 |

FOREIGN PATENT DOCUMENTS

| | | | |
|---|---|---|---|
| 3441994 | 5/1985 | Germany . | |
| 59-28082 | 2/1984 | Japan . | |
| 2146201 | 6/1990 | Japan | 418/55.2 |
| 5149264 | 6/1993 | Japan | 418/55.3 |

*Primary Examiner*—John J. Vrablik
*Attorney, Agent, or Firm*—Brooks Haidt Haffner & Delahunty

[57] ABSTRACT

A scroll type compressor has a movable scroll which is supported by a drive shaft by way of an eccentric pin in a housing. The movable scroll engages in an orbital movement for defining a compression chamber with a fixed scroll which is disposed opposite to the movable scroll. The compression chamber decreases in size in accordance with the orbital movement of said movable scroll for compressing gas in the compression chamber. A first ring orbits together with the movable scroll between the movable scroll and the housing, for receiving compressive reaction force acting on the movable scroll. A second ring which is secured to the housing receives the compressive reaction force received by and acting on the ring.

10 Claims, 7 Drawing Sheets

SCROLL TYPE COMPRESSOR HAVING A RING FOR COMPRESSIVE FORCE TRANSMISSION AND ORBIT DETERMINATION

BACKGROUND OF THE INVENTION

This is a continuation-in-part of co-pending U.S. application Ser. No. 08/128,827 filed Sep. 29, 1993 which is incorporated herein by reference.

FIELD OF THE INVENTION

The present invention relates to a scroll type compressor, which has compression chambers defined between a fixed scroll and an orbiting scroll. As the orbiting scroll engages in an orbiting movement, the volumes of the compression chambers decrease and thereby compress refrigerant gas in the compression chambers.

DESCRIPTION OF THE RELATED ART

Japanese Unexamined Patent Publication No. 59-28082 discloses a mechanism for causing the orbiting scroll to revolve in a scroll type compressor. As shown in FIGS. 6 and 7, this mechanism has rings 70 and 71 secured via races 74 and 75 to the opposite surfaces of a housing 72 and thereby to an orbiting scroll 73. A plurality of pockets 76 and 77 are formed in the rings 70 and 71, respectively. Columnar elements 78 are provided in the associated, facing pockets 76 and 77. The elements 78 are held between the races 74 and 75. As a drive shaft 79 rotates, the orbiting scroll 73 revolves around the axis of the drive shaft 79 with a predetermined radius. As the orbiting scroll 73 revolves or makes an orbital movement, compression chambers 81, defined between the orbiting scroll 73 and fixed scroll 80, are shifted toward the center of the fixed scroll 80. As the compression chambers 81 rotate toward the center of fixed scroll 80, the volume defined by the chambers 81 decreases. As a result, the gas in each compression chamber is compressed and the compressed gas is discharged outside via a discharge port 82.

A compressive reaction force acts on the orbiting scroll 73 along the axis of the drive shaft 79. The elements 78 transmit the compressive reaction force to the housing 72, and the housing 72 receives the compressive reaction force. In order to most efficiently handle the compressive reaction force, the elements 78 should be formed having a large diameter. If the diameter of the pockets 76 and 77 are large, it is possible to increase the diameter of the elements 78. This, however, requires that the width of that portion of rings 70 and 71 containing pockets 77 and 76 be large as well. Such an increase to the width of the rings 70 and 71 results in an increase in the diameter of the compressor and thus enlarges the compressor's size.

Alternatively, if the overall number of the elements 78 is increased, each element 78 need not have such a large diameter. However, an increase in the number of the elements 78 increases the number of pockets 76 and 77. Those pockets 76 and 77 and the elements 78, which define the radius of the orbital movement of the orbiting scroll 73, require a high precision process for their manufacture. Such an increase in the number of the pockets 76 and 77 and in the elements 78 would therefore lead to an increase in manufacturing time and cost for the compressor.

The races 74 and 75 are prevented from rotating by a plurality of pins 83 pressure fitted into the holes provided in the housing 72 and orbiting scroll 73. The insertion of the pins 83 in the holes of housing 72, however, requires that the diameter of the pins 83 should accurately match that provided by the holes. This requirement further increases the time and expense required to manufacture this type of compressor.

SUMMARY OF THE INVENTION

Accordingly, it is a primary objective of the present invention to provide a compressor which is designed to have a smaller diameter and which can be made compact in size.

It is another objective of the present invention to provide a compressor which requires fewer elements and pockets to reduce the number of components and facilitate the manufacturing of the compressor.

It is a further objective of the present invention to provide a compressor which eliminates the need for pine for races, thus facilitating the manufacturing of the compressor.

It is a still further objective of the present invention to design a light weight compressor.

A compressor embodying the present invention has a housing on which a drive shaft having an eccentric pin is supported. An orbiting scroll is supported on the eccentric pin in such a way that it cannot rotate but can revolve together with the eccentric pin. Compression chambers are defined between a fixed scroll and the orbiting scroll, so that as the orbiting scroll revolves, the volumes of the compression chambers decrease, thus compressing a refrigerant gas in the compression chambers.

A first ring, surrounding the drive shaft, is disposed between the orbiting scroll and the housing. The first ring receives compressive reaction force which acts on the orbiting scroll along the axis of the drive shaft. A plate, secured to the inner wall of the housing, receives compressive reaction force which acts on the ring.

BRIEF DESCRIPTION OF THE DRAWINGS

The features of the present invention that are believed to be novel are set forth with particularity in the appended claims.

The invention, together with objects and advantages thereof, may best be understood by reference to the following description of the presently preferred embodiments together with the accompanying drawings in which:

FIG. 1 is a vertical cross section of a scroll type compressor according to this embodiment.

FIG. 2 is a cross section of the compressor taken along line II—II in FIG. 1.

FIG. 3 is a transverse cross section showing the scroll type compressor in which an orbiting scroll is revolved by 180 degrees from the position shown in FIG. 2.

FIG. 4 is an exploded perspective view of the scroll type compressor.

DETAILED DESCRIPTION OF THE PREFERRED EMBODIMENTS

One embodiment of the present invention will now be described specifically, with reference to FIGS. 1 through 4.

Figure 1:
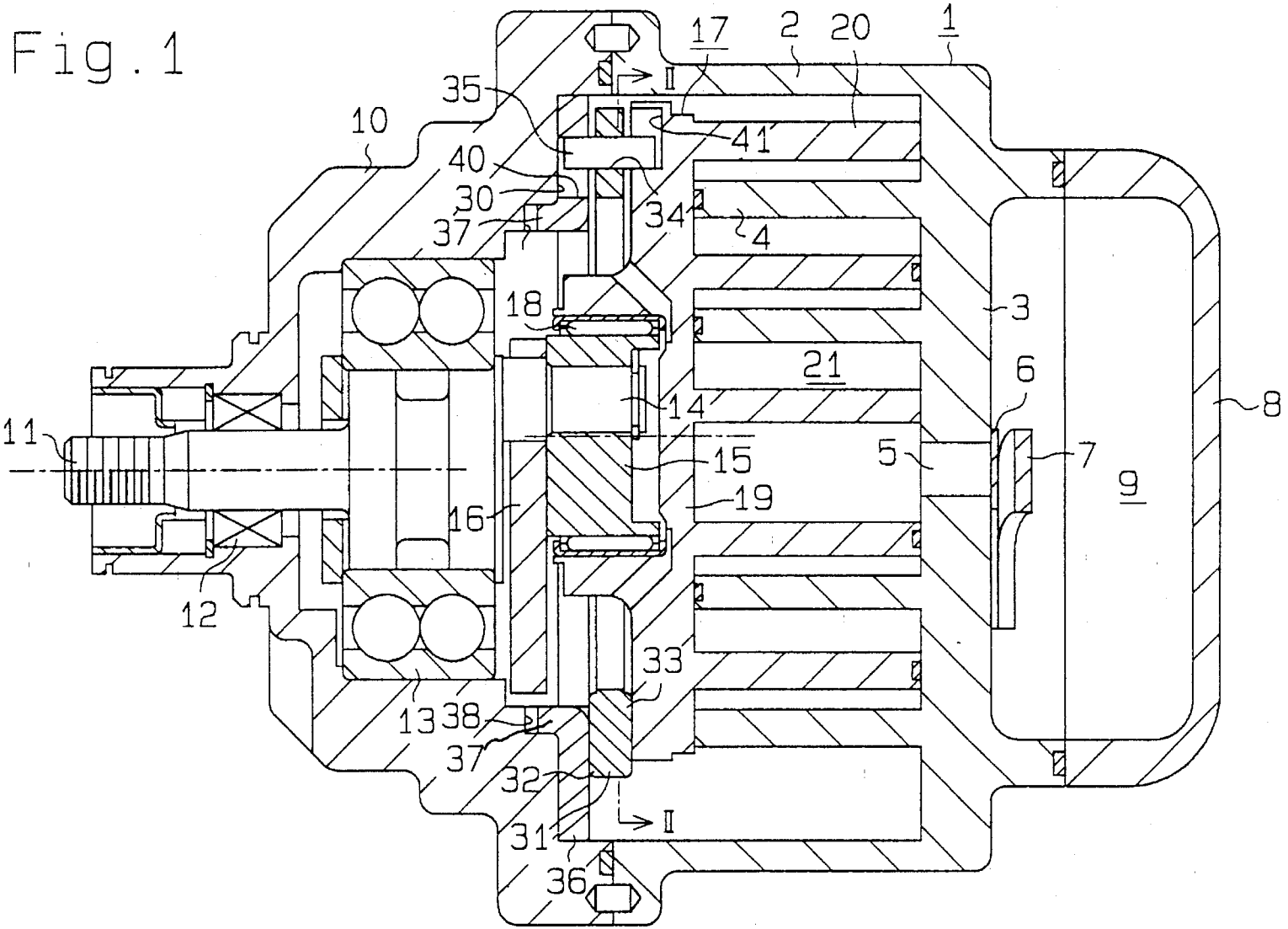
FIGS. 1 through 4 illustrate one embodiment of the present invention.

As shown in FIG. 1, an aluminum fixed scroll 1 has a casing 2, an end plate 3 and a spiral element 4. A discharge port 5 is formed in the end plate 3 and is positioned in the spiral center of the spiral element 4. A reed valve 6 is provided to open and close the discharge port 5. A retainer 7 serves to prevent the reed valve 6 from being open too much. An outer wall 8 is fixed to the outer surface of the end plate 3, with a discharge chamber 9 defined between the end plate 3 and the outer wall 8. The discharge chamber 9 is connected to an external cooling circuit via a pipe (not shown).

An aluminum housing 10 is secured to the fixed scroll 1. A drive shaft 11 is rotatably supported in the housing 10 via bearings 12 and 13, with an eccentric pin 14 secured to the drive shaft 11. The drive shaft 11 is coupled to an engine (not shown).

The eccentric pin 14 rotatably supports a bushing 15 which in turn supports a counter balancing weight 16. An orbiting scroll 17, rotatably supported by the bushing 15 via radial bearings 18, faces the fixed scroll 1. The orbiting scroll 17 also has an end plate 19 and a spiral element 20. Compression chambers 21 are defined by the end plates 3 and 19 and the spiral elements 4 and 20 of the scrolls 1 and 17.

A pressure receiving surface 30 is formed inside the housing 10 in a plane perpendicular to the axis of the drive shaft 11.

An aluminum first ring 31, which surrounds the drive shaft 11, is disposed between the end plate 19 of the orbiting scroll 17 and the pressure receiving surface 30. A plurality of pressure receiving projections 32 are integrally formed on the housing side of the first ring 31. A plurality of pressure receiving projections 33 are likewise integrally formed on the orbiting-scroll side of the first ring 31, at the back of the projections 32. The projections 32 and 33 are arranged at equiangular distances.

The first ring 31 has holes 34 in which rotation inhibiting elements or rod-shaped pins 35 are fitted so that the anti-rotation elements 35 are securely attached to the first ring 31. The anti-rotation elements 35, made of a copper-base metal, are located between every pair of adjoining projections 32 and 33.

A ring-shaped pressure receiving ring 36 of an iron-base metal is disposed between the pressure receiving surface 30 and the first ring 31. The inner periphery of the pressure receiving ring 36 is bent at a plurality of points to form a plurality of projections 37. A plurality of recesses 38 are formed at the inner periphery of the pressure receiving surface 30 to receive the projections 37. As the projections 37 are fitted in the recesses 38, the second ring 36 is immovably secured to the housing 30.

The same number of pockets 40 as the anti-rotation elements 35 are formed in the second ring 36, and the same number of pockets 41 as the anti-rotation elements 35 are formed in the end plate 19 of the orbiting scroll 17. The individual pockets 40 or 41 are arranged at equal intervals. The ends of the anti-rotation elements 35 are respectively fitted in the pockets 40 and 41. The height of each of the anti-rotation elements 35 from the end faces of the projections 32 and 33 is made smaller than the depth of the pockets 40 and 41. Therefore, the end faces of the anti-rotation elements 35 do not contact the bottoms of the associated pockets 40 and 41.

When the drive shaft 11 rotates, the eccentric pin 14 revolves about the axis of the drive shaft 11 with a given radius. As the eccentric pin 14 revolves, the orbiting scroll 17 makes an orbital movement about the axis of the drive shaft 11, so that the refrigerant gas is introduced through an inlet port (not shown) into the compression chambers 21 between the scrolls 1 and 17. Each compression chamber 21 is shifted toward the center portions of the spiral elements 4 and 20 of the scrolls 1 and 17 while decreasing its volume. As a result, the refrigerant gas is compressed in the compression chamber 21. The compressed gas is then discharged into the discharge chamber 9 through the discharge port 5, pushing the reed valve 6 backward. The gas is supplied to the external cooling circuit from the discharge chamber 9.

The compressive reaction force produced in the compression chamber 21 acts on the end plate 19 of the orbiting scroll 17 along the axis of the drive shaft 11. The reaction force on the end plate 19 is received by the second ring 36 via the projections 32 and 33 of the first ring 31.

As the orbiting scroll 17 revolves, the projections 33 slide on the end plate 19 and the projections 32 slide on the second ring 36.

The surface of the orbiting scroll 17, including the inner walls and bottoms of the pockets 41, is plated with a hardened nickel phosphate. The projections 33 of the ring 31 made of aluminum and the end plate 19 coated with the hardened nickel phosphate prevent from being seized even under the pressure and the frictional heat generated between the projections 33 and the end plate 19, because both are made of different metals which are difficult to be welded together. After the compressor stops, therefore, the projections 33 and the end plate 19 prevent from being seized. Likewise, the second ring 36 of an iron-base metal and the aluminum projections 32 prevent from being seized.

Figure 2:
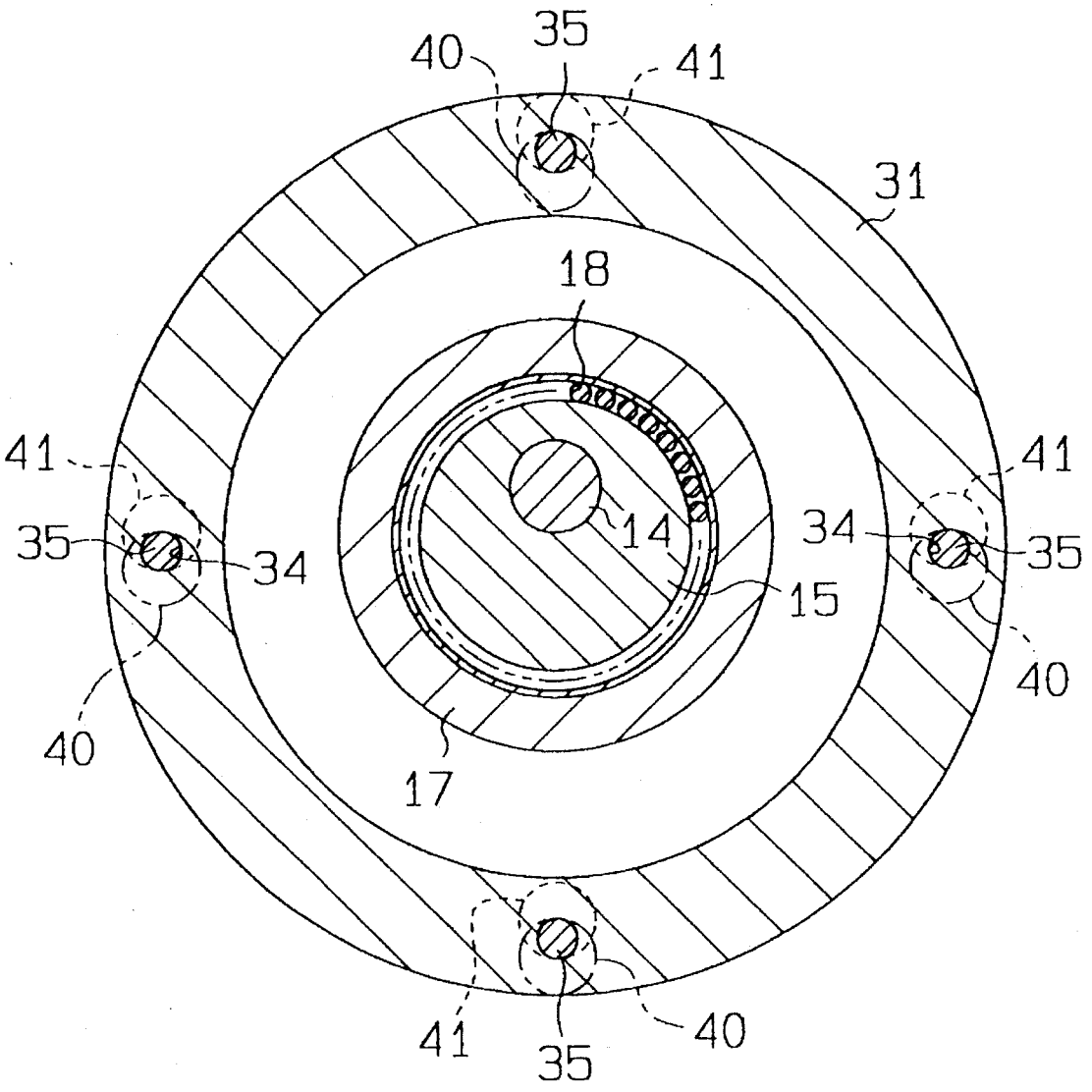
Figure 3:
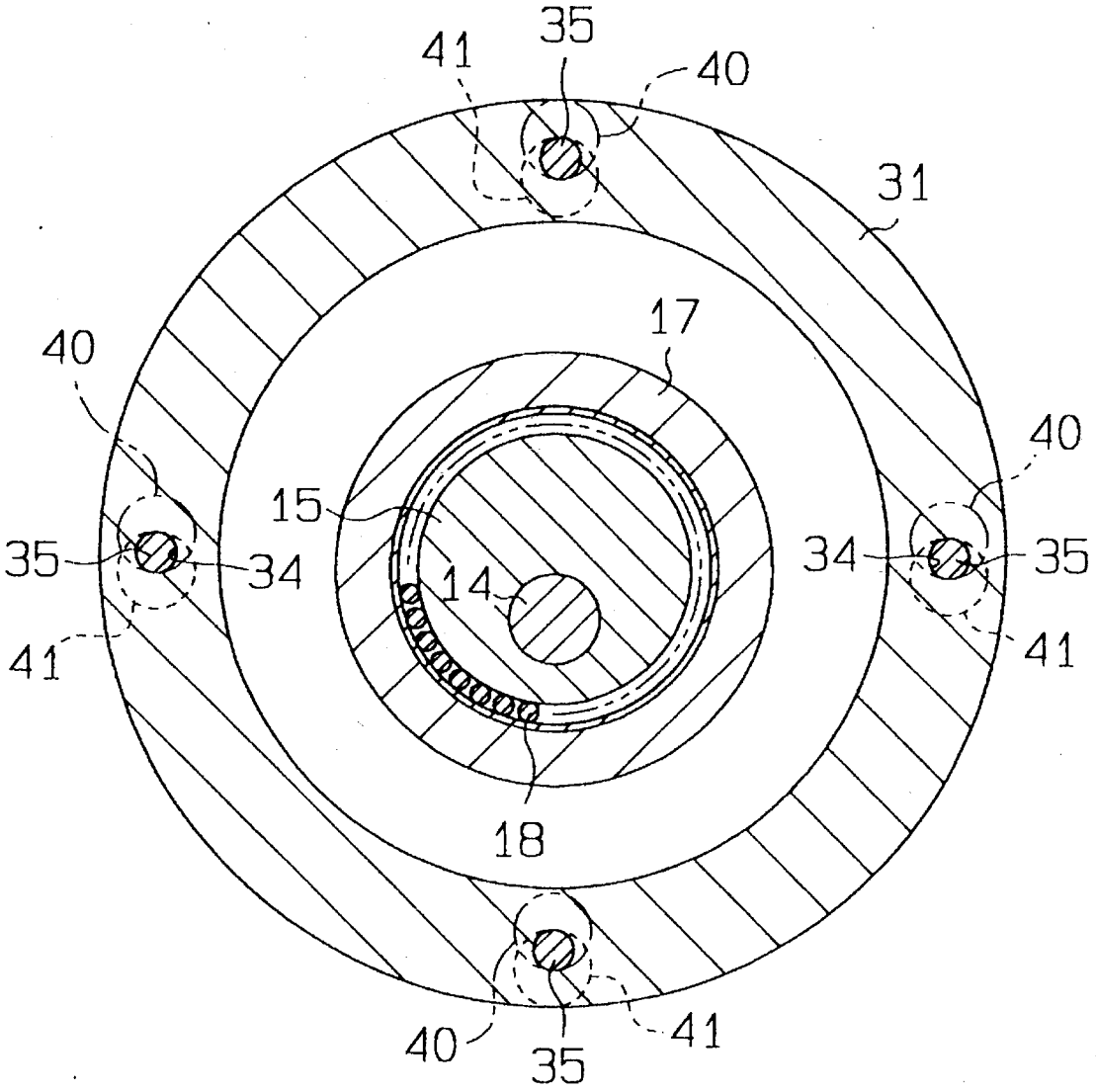
Figure 4:
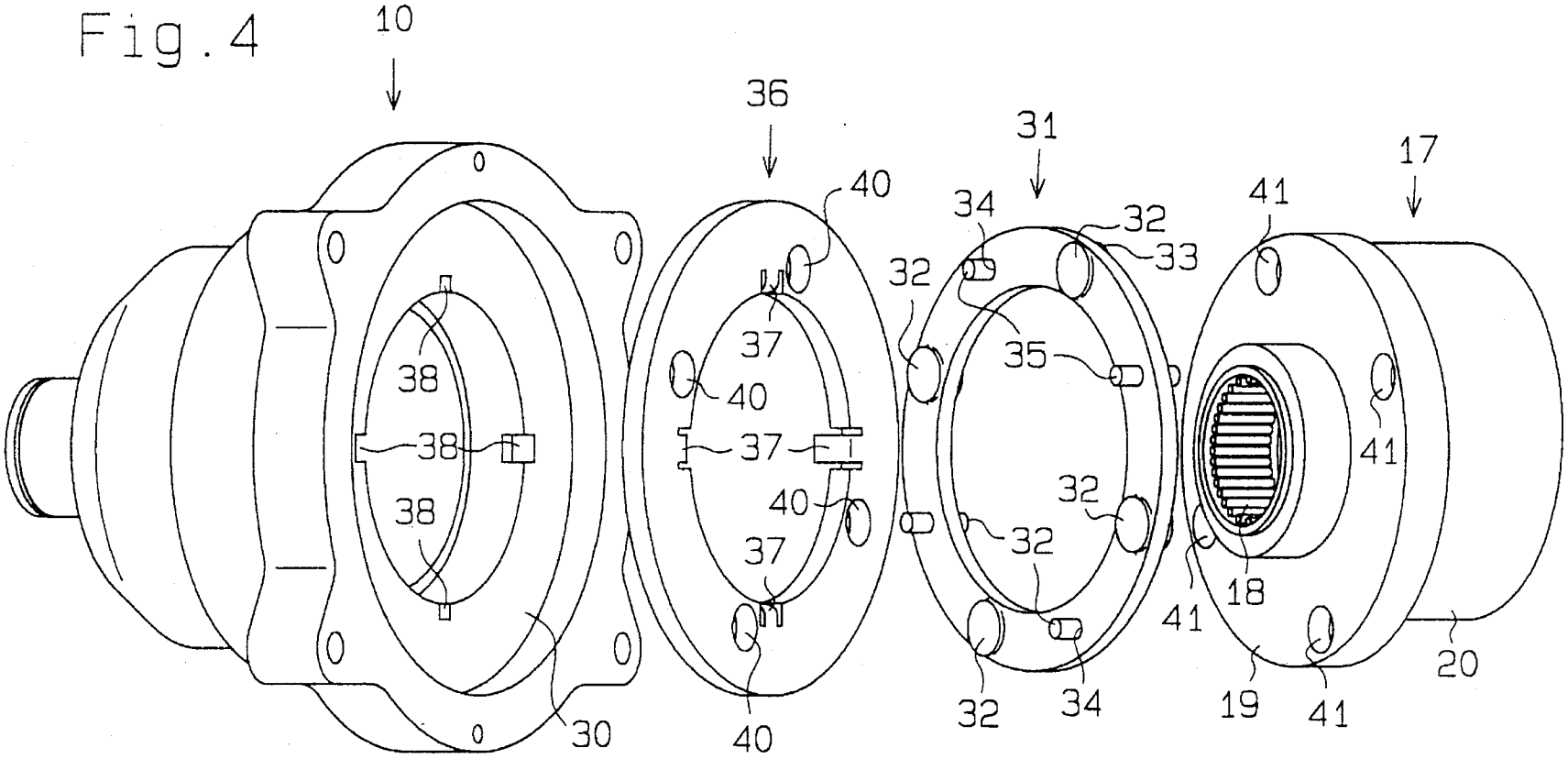

FIGS. 2 and 3 show the orbiting scroll 17 in positions 180 degrees opposite to each other.

As the orbiting scroll 17 makes an orbital movement, the anti-rotation elements 35 slide on the inner walls of the associated pockets 40 and 41. Given a configuration where the diameter of the pockets 40 and 41 is $\alpha$ and the diameter of the anti-rotation elements 35 is $\beta$, when the orbiting scroll 17 moves to the position in FIG. 3 from the position in FIG. 2, the anti-rotation elements 35 move relative to the associated pockets 40 and 41 by $\alpha-\beta$. This value is equal to the radius $\gamma$ of the revolution of the bushing 15. Thus, the diameter $\alpha$ of the pockets 40 and 41, the diameter $\beta$ of the projections 35 and the radius $\gamma$ have a relation of $$\alpha=\beta+\gamma$$

which defines the radius r of the revolution of the orbiting scroll 17.

The anti-rotation elements 35 slide on the inner walls of the associated pockets 41 as mentioned above. In as much as the anti-rotation elements 35 are made of a copper-base metal and the orbiting scroll 17 is made of aluminum, the sliding portions of the elements 35 and the scroll 17 prevent from being seized. After the compressor stops, therefore, the anti-rotation elements 35 and the orbiting scroll 17 prevent from being seized.

The anti-rotation elements 35 also slide on the inner walls of the associated pockets 40 of the second ring 36. In as much as the anti-rotation elements 35 are made of copper-base metal and the second ring 36 is made of iron-base metal, the sliding portions of the elements 35 and the second ring 36 prevent from being seized.

Moreover, the first ring 31 tends to rotate about the rotational axis of the bushing 15. Since the anti-rotation elements 35 contact the inner walls of the pockets 40 of the second ring 36, however, the first ring 31 will not rotate about the center axis of the bushing 15.

The orbiting scroll 17 also tends to rotate about the rotational axis of the bushing 15. Since the anti-rotation elements 35 on the non-rotating first ring 31 are fitted in the associated pockets 41 of the end plate 19, however, the orbiting scroll 17 will not rotate about the center axis of the bushing 15.

The scroll type compressor according to this embodiment has one ring, fewer by one than the two rings 70 and 71 of the conventional scroll type compressor disclosed in Japanese Unexamined Patent Publication No. 59-28082. That is, the compressor of this embodiment has fewer components and is thus lighter than the conventional compressor.

As mentioned earlier, the processing of the inner walls of the embodiment serve to transmit compressive reaction force, the compressor requires fewer anti-rotation elements 35. Although four anti-rotation elements 35 are used, a minimum of at least three elements 35 can be used for this invention. Likewise, a minimum of at least three pockets 40 or 41 can be used for this invention. Since the number of pockets that needs high processing precision can be reduced, the time needed to process the pockets can be shortened.

The second ring 36 of an iron-base metal receives the compressive reaction force applied on the first ring 31. The housing 10 can be made of aluminum in this embodiment, so that the weight of the compressor can be reduced.

Since the anti-rotation elements 35 do not contact the bottoms of the associated pockets 40 and 41, the elements 35 can be designed long enough so that they will not come out of the pockets 40 and 41. It is therefore unnecessary that the length of the anti-rotation elements 35 be precisely machined. This is another facet of the present invention which reduces the overall costs of manufacturing a compressor.

The second ring 36 contacts the rotating elements 35 and tends to rotate together with the elements 35. The turning of the plate 36, however, is inhibited by the engagement of the projections 37 with the recesses 38.

As the projections 37, integrally formed on the second ring 36, engage with the recesses 38 of the housing 10, it is unnecessary to use pins to attach the second ring 36. This design will reduce the number of components necessary for constructing the compressor. Conventional compressors use structures in which pins are inserted in the associated holes under pressure. This requires that the diameter of the pins accurately match with that of the holes in order to prevent the pins from coming out later. In addition, the insertion of the pins presents unnecessary manufacturing difficulties. Since the second ring 36 is pressed against the pressure receiving surface 30 by the compressive reaction force in this embodiment, in contrast, the second ring 36 will not be separated from the surface 30. The engaging precision between the projections 37 and the recesses 38 need not be very high but should be high enough to prevent the rotation of the second ring 36. Further, it is very easy to attach the second ring 36 to the surface 30.

Although only one embodiment of the present invention has been described herein, it should be apparent to those skilled in the art that the present invention may be embodied in many other specific forms without departing from the spirit or scope of the invention. Particularly, it should be understood that following modes are to be applied.

Figure 5:
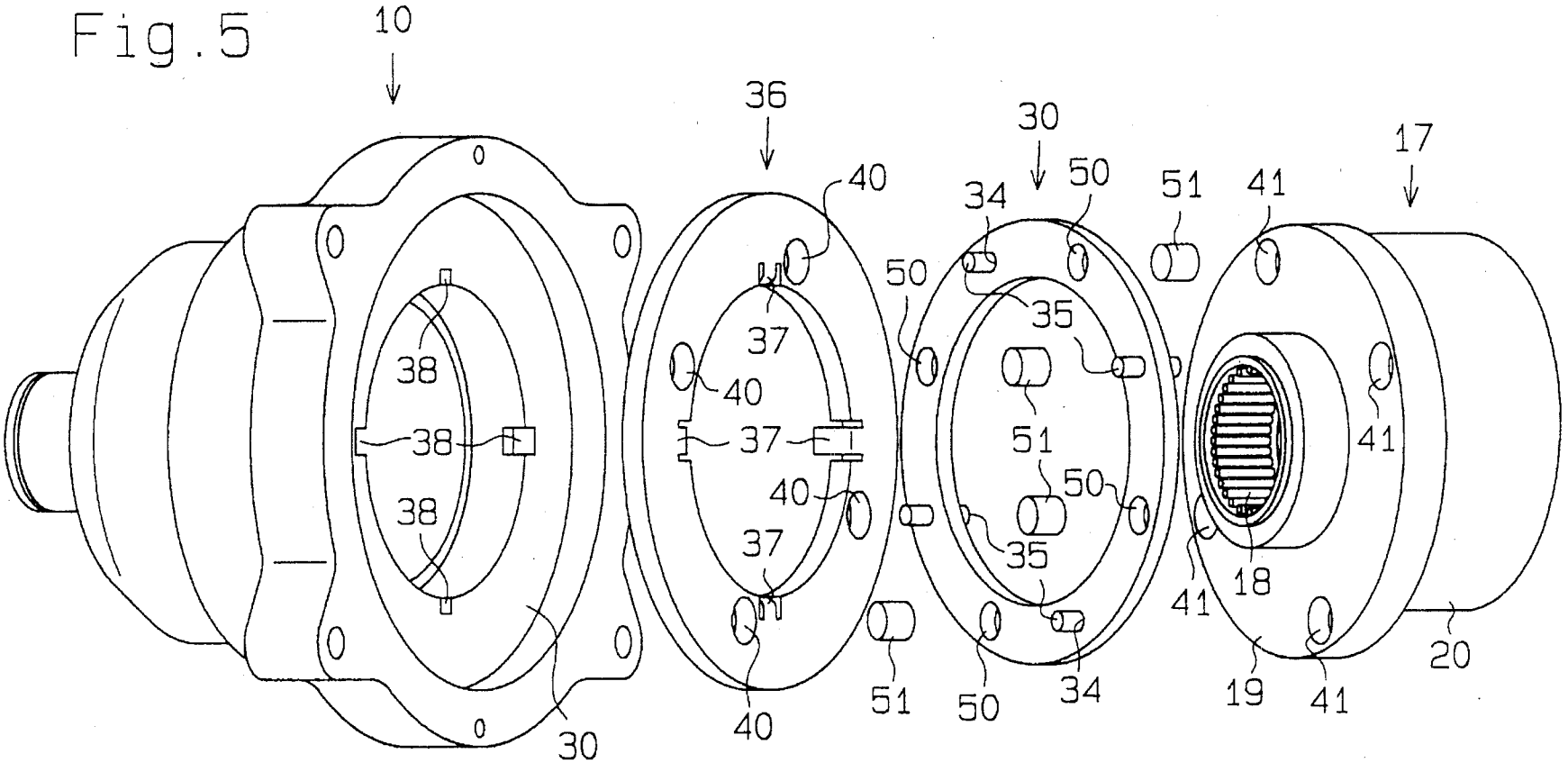
FIG. 5 is an exploded perspective view showing a compressor according to another embodiment of the present invention.
Figure 6:
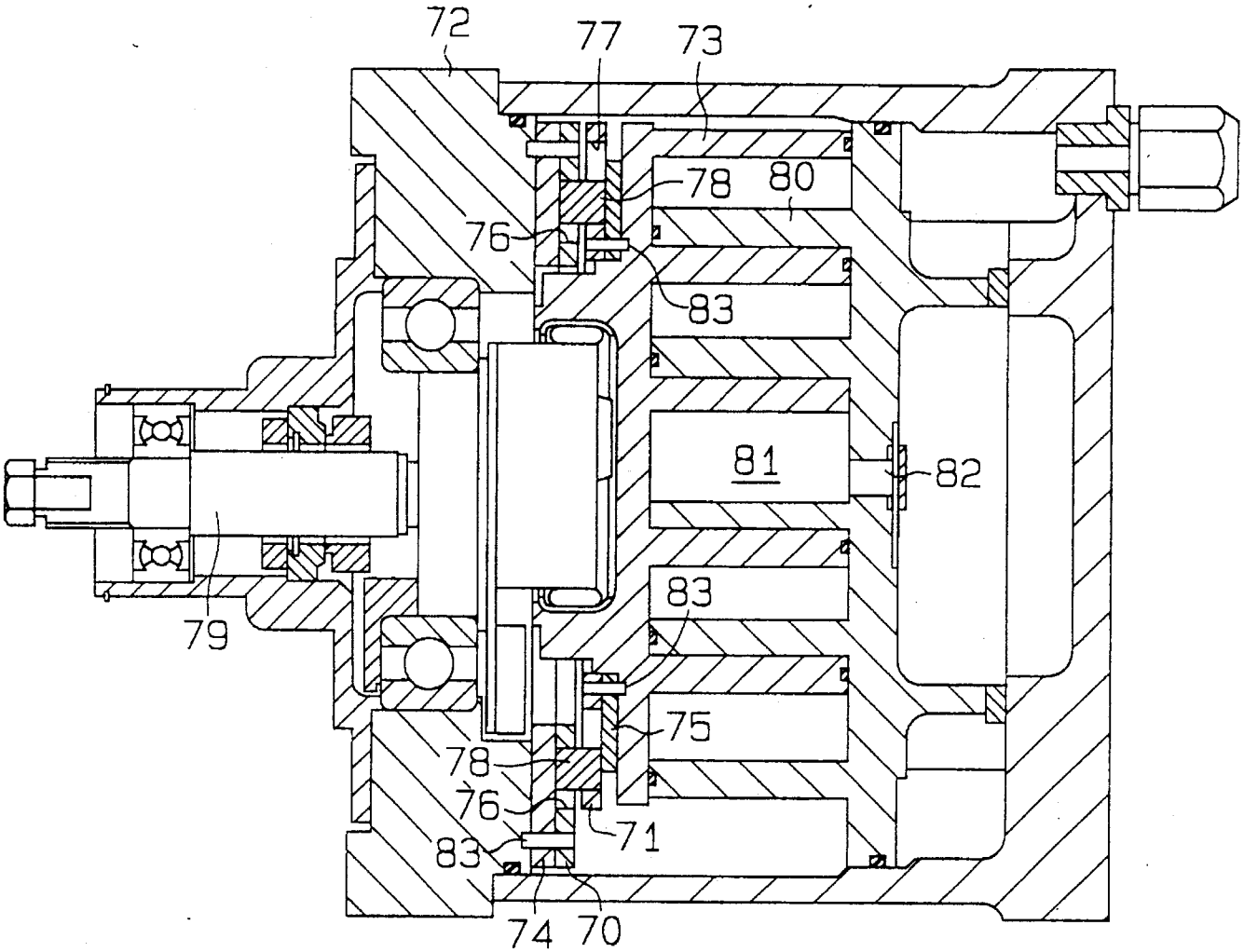
Fig. 6 (Prior Art)
FIG. 6 is a vertical cross section of a conventional scroll type compressor.
Figure 7:
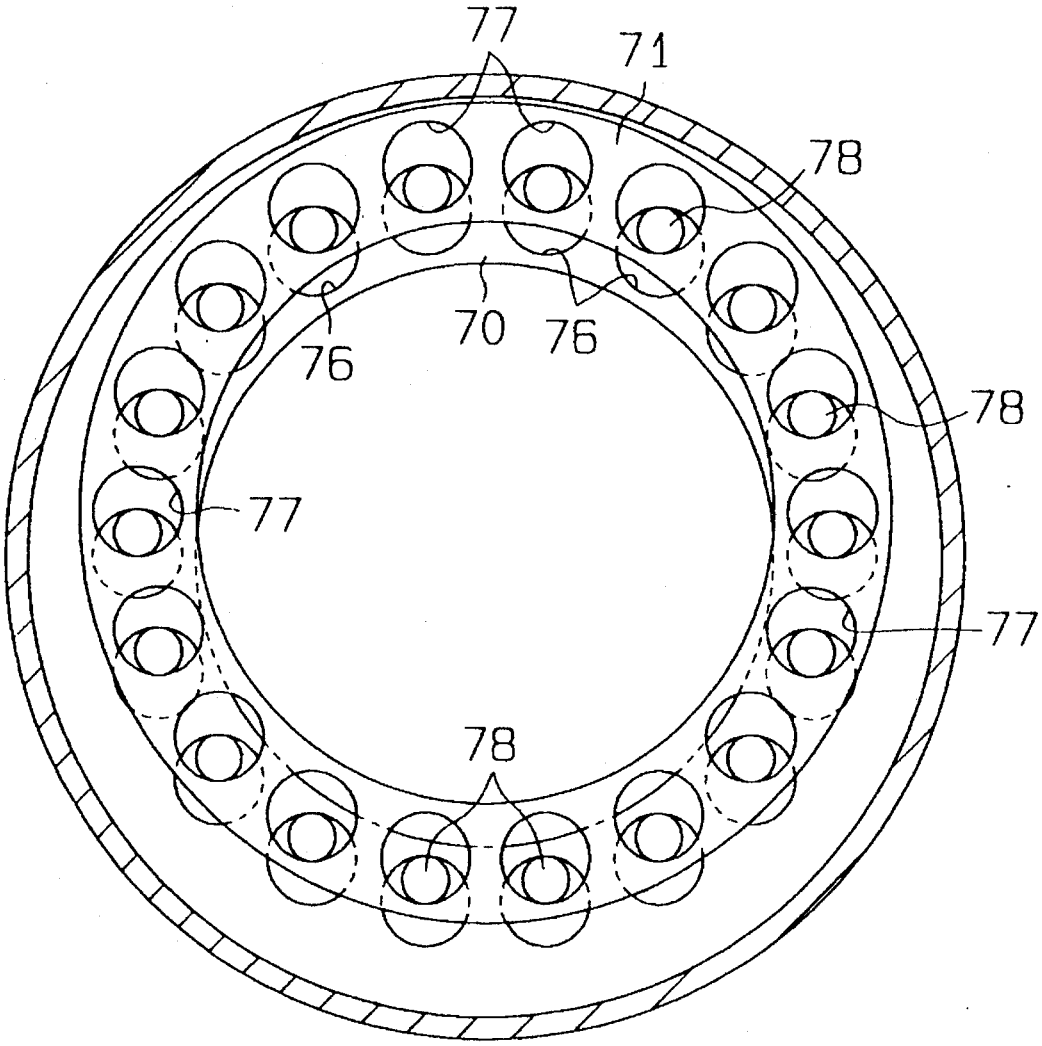
Fig.7 (Prior Art)
FIG. 7 is a transverse cross section of the scroll type compressor in FIG. 6.

For example, holes 50 may be formed in a first ring 31 with pins 51 inserted in the associated holes 50 as shown in FIG. 5. The pins 51 receive the compressive reaction force from the orbiting scroll 17 and transmit the force to the second ring 36.

A pressure receiving plate may be connected to the end plate 19 of the orbiting scroll 17. In this case, the projections are provided on the outer surface of that plate and the recesses are formed in the outer surface of the end plate 19.

Therefore, the present examples and embodiment are to be considered as illustrative and not restrictive and the invention is not to be limited to the details given herein, but may be modified within the scope of the appended claims.

What is claimed is:

1. A scroll type compressor having a movable scroll eccentrically orbitable about a drive shaft in a housing for defining a compression chamber in cooperation with a fixed scroll disposed opposite the movable scroll, said compression chamber decreasing in size in accordance with the orbital movement of said movable scroll for compressing gas in the compression chamber, said housing and said movable scroll being made of aluminum, and said compressor further comprising:

a first ring orbitable with the movable scroll between the movable scroll and the housing for receiving compressive reaction force acting on the movable scroll parallel to the axis of the drive shaft;

a second ring engaged with the housing for receiving the compressive reaction force received by and acting on said first ring, said second ring being made of an iron-base metal;

a plurality of projections and corresponding recesses provided, respectively, on said second ring and said housing with said projections inserted in the corresponding recesses to prevent said second ring from rotating relative to said housing;

force transmitting means on said first ring for transmitting said compressive reaction force from the movable scroll to the second ring; and movement determining means disposed on said first ring for determining the orbit of the movable scroll, said movement determining means being separate from said force transmitting means.

2. A scroll type compressor having a movable scroll eccentrically orbitable about a drive shaft in a housing for defining a compression chamber in cooperation with a fixed scroll disposed opposite the movable scroll, said compression chamber decreasing in size in accordance with the orbital movement of said movable scroll for compressing gas in the compression chamber, said housing and said movable scroll being made of aluminum, and said compressor further comprising:

a first ring orbitable with the movable scroll between the movable scroll and the housing for receiving compressive reaction force acting on the movable scroll parallel to the axis of the drive shaft;

a second ring engaged with the housing for receiving the compressive reaction force received by and acting on said first ring, said second ring being made of an iron-base metal;

a plurality of load bearing members disposed about said first ring for transferring the compressive reaction force from the movable scroll to the second ring;

a plurality of projections and corresponding recesses provided, respectively, on said second ring and said housing with said projections inserted in the corresponding recesses to prevent said second ring from rotating relative to said housing;

a plurality of cylindrical elements disposed about said first ring for preventing the movable scroll from rotating about its axis; and a plurality of cylindrical pockets in both said movable scroll and said second ring into which are slidably disposed said cylindrical elements, each pocket having a larger diameter than each cylindrical element for permitting the orbital movement of the movable scroll, each pocket having a bottom at a sufficient depth to avoid contact between the associated cylindrical element and the bottom of the pocket.

3. The scroll type compressor according to claim 2, wherein said first ring is made of aluminum.

4. The scroll type compressor according to claim 2, wherein said load bearing members are integrally formed with said first ring.

5. The scroll type compressor according to claim 2, wherein said load bearing members are in the form of pins fitted in holes formed in said first ring.

6. The scroll type compressor according to claim 2, wherein said projection consist of deformed portions of said second ring.

7. The scroll type compressor according to claim 2, wherein said second ring has a plurality of holes disposed about said second ring, and wherein said cylindrical elements comprise pins inserted into said holes.

8. The scroll type compressor according to claim 2, wherein said cylindrical elements are equidistantly spaced circumferentially from each other, and said pockets are equidistantly spaced circumferentially from each other about each of said movable scroll and said second ring.

9. The scroll type compressor according to claim 2, wherein said movable scroll has a hardened surface.

10. The scroll type compressor according to claim 7, wherein said first ring is made of aluminum and said pins are made of a copper-base metal, and wherein said movable scroll and said movable scroll pockets have hardened inner walls.

* * * * *

UNITED STATES PATENT AND TRADEMARK OFFICE

CERTIFICATE OF CORRECTION

PATENT NO. : 5,470,213
DATED : November 28, 1995
INVENTOR(S) : M. Iguchi et al

It is certified that error appears in the above-indentified patent and that said Letters Patent is hereby corrected as shown below:

Column 2, line 21, "pine" should read --pins--.

Column 8, line 3, "projection" should read --projections--.

Signed and Sealed this

Ninth Day of April, 1996

Bruce Lehman

*Attest:*

BRUCE LEHMAN

*Attesting Officer*

*Commissioner of Patents and Trademarks*